United States Patent [19]

Nabulon

[11] Patent Number: 4,941,242

[45] Date of Patent: Jul. 17, 1990

[54] THREAD TREATING NOZZLES

[75] Inventor: Werner Nabulon, Schneehalde 116, 8455 Rudlingen, Switzerland

[73] Assignee: Rieter Machine Works, Ltd., Winterthur, Switzerland

[21] Appl. No.: 306,250

[22] Filed: Feb. 2, 1989

Related U.S. Application Data

[63] Continuation of Ser. No. 904,360, Sep. 8, 1986, abandoned, which is a continuation-in-part of Ser. No. 677,591, Dec. 3, 1984, abandoned.

[51] Int. Cl.[5] ..... D02G 1/16; D02G 1/12

[52] U.S. Cl. ..... 28/255; 28/272

[58] Field of Search ..... 28/255, 272; 226/97

[56] References Cited

U.S. PATENT DOCUMENTS

| | | | |
|---|---|---|---|
| 3,237,269 | 3/1966 | Hawkins | 28/272 |
| 3,261,071 | 7/1966 | Clendening, Jr. et al. | 28/272 |
| 3,324,526 | 6/1967 | Burns et al. | 28/272 X |
| 3,698,612 | 10/1972 | Brock | 28/272 X |
| 4,416,041 | 11/1983 | Guyer et al. | 28/272 X |
| 4,453,298 | 6/1984 | Nakulon et al. | 28/272 X |
| 4,644,622 | 2/1987 | Bauer et al. | 28/272 X |

FOREIGN PATENT DOCUMENTS

| | | | |
|---|---|---|---|
| 0026360 | 3/1981 | European Pat. Off. | 28/272 |
| 0108205 | 5/1984 | European Pat. Off. | 28/255 |
| 542450 | 1/1979 | Japan | 28/255 |

*Primary Examiner*—Werner H. Schroeder
*Assistant Examiner*—Bradley Kurtz DeSandro
*Attorney, Agent, or Firm*—Kenyon & Kenyon

[57] ABSTRACT

The nozzle comprises a plurality of parts which define between them a thread-treating passage and which are movable relative to each other for opening and closing the thread-treating passage to enable insertion of a thread. The thread-treating nozzle preferably comprises only two nozzle parts movable relative to each other. One nozzle part comprises a plate-like element which is elastic when subjected to the degree of deformation required to permit adjustment thereof to make face-to-face sealing contact. Mechanical elements capable of effecting uniform face-to-face sealing contact press the two nozzle parts together in the closed state. Examples of such mechanical elements are levers and springs.

22 Claims, 5 Drawing Sheets

THREAD TREATING NOZZLES

This application is a continuation of Ser. No. 06/904,360, filed Sept. 8, 1986 (now abandoned) which is a continuation-in-part of application Ser. No. 06/677,591, filed Dec. 3, 1984 (now abandoned).

BACKGROUND OF THE INVENTION

The present invention broadly relates to thread-treating nozzles and, more specifically, pertains to a new and improved construction of an openable and closable thread-treating nozzle.

Generally speaking, the thread-treating nozzle of the present invention relates to developments and improvements in the system disclosed in the published European Patent Application No. 110,359, published June 13, 1984, corresponding to the above cross-referenced U.S. application Ser. No. 81,051, filed Oct. 2, 1979, the disclosure of which is hereby incorporated in the present specification by reference.

The present invention also relates to developments and improvements in the thread-treating nozzle described and claimed in the published European Patent Application No. 85/112,265.5, published on June 18, 1986 under the Publication No. 184,625, and in the above cross-referenced cognate and present parent U.S. patent application Ser. No. 06/677,591 filed Dec. 3, 1984, in the name of applicant and entitled "THREAD-TREATING NOZZLE". These two Patent Applications will be referred to hereinafter as the "prior applications".

In its more particular aspects, the present invention relates to an openable and closable thread-treating nozzle, that is, a nozzle comprising a plurality of nozzle parts which define between them a thread-treating passage and which are movable relative to each other for opening and closing the thread-treating passage to enable insertion of a thread. The term "nozzle" when used hereinafter refers to an openable and closable nozzle as defined above. Such a nozzle preferably comprises only two nozzle parts movable relative to each other.

In the earlier of the prior applications, namely European Published Patent Application No. 110,359, published June 13, 1984, and the cognate U.S. application Ser. No. 81,051, filed Oct. 2, 1979, at least one nozzle part of the nozzle was provided with a flexible mounting to permit adjustment of the nozzle part for making face-to-face sealing contact with another nozzle part or other parts of the nozzle. It has now been realized that at least some of the required flexibility can advantageously be incorporated in the nozzle part itself.

The flexible nozzle part is, however, still advantageously associated with a flexible mounting. Such a mounting preferably comprises balancing means for distributing nozzle closing forces over the nozzle part.

The subsequent two "prior applications" describe an arrangement which, for convenience, will be referred to briefly as an "elastic-sided" thread-treating nozzle. The nozzle comprises a plurality of nozzle parts which define a thread-treating passage between them. The nozzle parts are movable relative to each other to enable opening of the nozzle for thread insertion, and subsequent closing of the nozzle with the thread in the thread-treating passage. In accordance with these two "prior applications", at least one nozzle part is made elastic under closing forces applied in use, so as to ensure that sealing contact between the nozzle parts is made around the thread-treating passage.

An analogous concept is broadly disclosed in British Patent No. 1,310,227 (corresponding to German Patent Publication No. 2,049,740), in particular in claim 2 thereof. It is therein proposed that the elastic nozzle part of the nozzle be made of polyurethane rubber. It is furthermore proposed that closure forces be applied to the nozzle by way of a lever acting adjacent a hinge joining the two nozzle parts. The closure forces are therefore created by application of a turning moment or torque tending to swing the elastic nozzle part around the hinge pin. For reasons which will be explained in further detail in the course of the description of the drawings, such an arrangement cannot perform suitably over a wide range of operating circumstances, involving in particular significant closing forces (high operating pressures in the nozzle passage) or high temperatures or combinations of both.

SUMMARY OF THE INVENTION

Therefore, with the foregoing in mind, it is a primary object of the present invention to provide a new and improved construction of a thread-treating nozzle which does not exhibit the aforementioned drawbacks and shortcomings of the prior art constructions.

Another and more specific object of the present invention aims at providing a new and improved construction of a thread-treating nozzle of the previously mentioned type in which the nozzle can be sealingly closed by forces having lines of action extending substantially perpendicular to the sealing surfaces without relying on eccentric forces or torques.

Yet a further significant object of the present invention provides a new and improved construction of a thread-treating nozzle which is relatively simple in construction and design, extremely economical to manufacture, highly reliable in operation, not readily subject to breakdown or malfunction and requires a minimum of maintenance and servicing.

Now in order to implement these and still further objects of the invention, which will become more apparent as the description proceeds, generally speaking the thread-treating nozzle of the present invention is manifested by the features that the nozzle part may comprise a plate-like element which is elastic when subjected to the degree of deformation required to permit adjustment thereof to make the face-to-face sealing contact referred to above.

This structure comprises first and second nozzle parts which define between them a thread-treating passage through the nozzle, the nozzle parts being movable relative to each other in order to open the nozzle to enable insertion of thread into the thread-treating passage and to close the nozzle around the thread. The structure further comprises infeed means for feeding a treatment fluid to the thread-treating passage to flow therethrough and draw or entrain the thread along the thread-treating passage. The first nozzle part of the nozzle has first and second sealing surfaces disposed on respective opposite sides of the thread-treating passage, and corresponding first and second sealing surfaces are provided on the second nozzle part. Closure force applying means is provided for applying closure forces urging the first and second sealing surfaces on the first nozzle part into engagement with the respective first and second sealing surfaces on the second nozzle part. At least one of the nozzle parts is flexible or elastically resilient under the action of the applied closure forces. The closure force applying means engages the flexible nozzle part on a face opposite to and substantially aligned with the thread-treating passage.

The result is that the force vectors or lines of action of the forces applied by the closure force applying means to the first nozzle part extend in directions substantially at right angles to the first and second sealing surfaces. This provides a more effective application of the closure force and therefore more effective sealing than prior art arrangements in which the closure forces are created by application of a turning moment or torque tending to swing the elastic nozzle part around a hinge pin.

The inventive arrangement also enables face-to-face sealing contact to be made on both sides of the thread-treating passage in sealing zones immediately adjacent the thread-treating passage. This means that the nozzle parts can be formed to provide a predetermined thread-treating passage cross-section, which will be maintained even under the application of closure force in use. This defines broad limits for the flexibility or elastic resiliency of the first nozzle part. The resiliency must be high enough to enable the first nozzle part to deform if necessary under the closure forces to enable such face-to-face sealing contact to be effectively made on both sides of the thread-treating passage. On the other hand, the resiliency must be low enough to prevent undesired deformation of the first nozzle part under the closure forces, or under the pressure of fluid in the passage, to the extent that undesired variations of the thread-treating passage cross-section not occur in use. The thread-treating passage cross-section need not, of course, necessarily be uniform along the length thereof. It may vary in a predetermined fashion along that length, but should not change in an indeterminate fashion in response to application of operating forces.

The closure force may be applied to the first nozzle part by contact of the closure force applying means with a zone of the first nozzle part which is localized relative to said first and second sealing surfaces on the nozzle parts, i.e. the area of the zone may be much less than that of the surfaces. As indicated in the aforementioned two "prior applications", however, the closure force applying means preferably contacts the first nozzle part at positions on respective different sides of the thread-treating passage, so that closing pressure is effectively generated on both sides of the thread-treating passage.

In one embodiment of the invention, which is in accordance with published European Patent Application No. 39,763 (corresponding to U.S. Pat. No. 4,453,298, granted June 12, 1984), the disclosure of which is also hereby incorporated by reference in the present specification, the thread-treating passage extends from end to end through an elongate nozzle structure. In such a structure, the flexible nozzle part also preferably extends from end to end of the structure.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
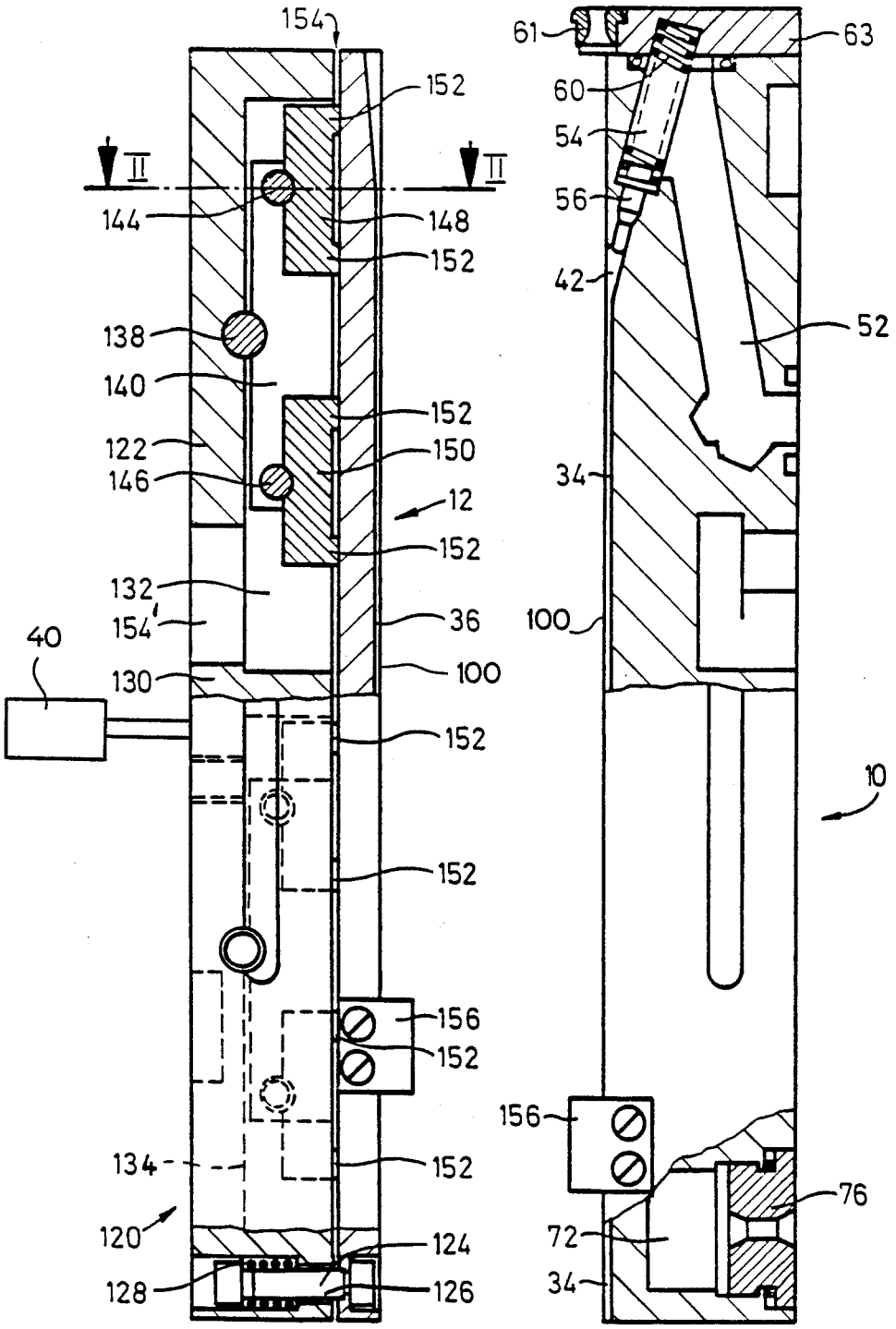
FIG. 1 is a vertical elevation, partly in section, of a two-part thread-treating or texturizing nozzle in accordance with a first embodiment of the invention.

The general structure and operation of the thread-treating or texturizing nozzle shown in the drawings has already been described in detail in European Patent Application No. 39,763 and the cognate U.S. Pat. No. 4,453,298, referred to above, and also in European Patent Application No. 108,205, published May 16, 1984 (corresponding to U.S. patent application Ser. No. 433,733, filed Oct. 12, 1982), now abandoned, the disclosure of which is also hereby incorporated in the present specification by reference.

In order to avoid superfluous description, the overall construction and operation of the thread-treating or texturizing nozzle will be described again here. The various parts of the illustrated thread-treating nozzle will, however, be identified and for ease of comparison the reference numerals used will correspond as far as possible with those used in the above-mentioned European Patent Application No. 108,205 and its cognate U.S. patent application Ser. No. 433,733.

Describing now the drawings, it is to be understood that to simplify the showing thereof only enough of the structure of the thread-treating or texturizing nozzle has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a two-part thread-treating or texturizing nozzle which can be opened for inserting a thread and subsequently closed. Accordingly, two nozzle parts are indicated with the numerals 10 and 12, respectively. Nozzle part 10 is mounted on a suitable, not particularly shown, carrier by mounting means, examples of which have already been disclosed in the prior applications referred to above. The mounting for the nozzle part 12 will be described in greater detail later in this specification.

Figure 2:
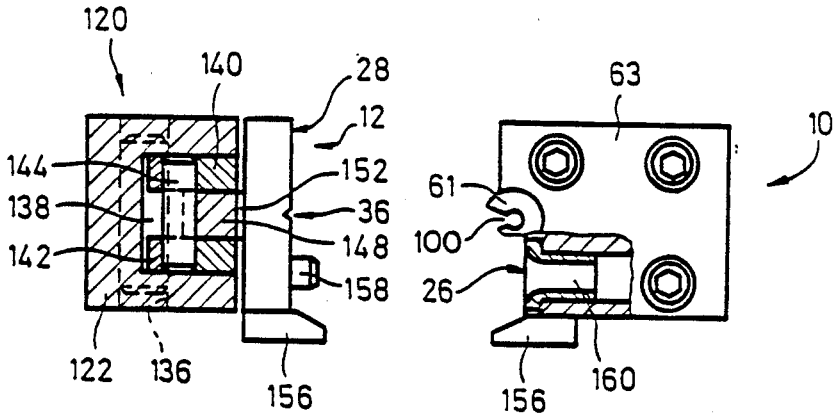
FIG. 2 is a plan view of the nozzle parts shown in FIG. 1, the left-hand part being sectioned on the plane II—II in FIG. 1.

Nozzle part 10 is in the form of an elongated block, made in one piece and having a substantially planar face 26 (see FIG. 2). Nozzle part 12 is in the form of an elongated plate-like element having a substantially planar face 28. When the thread-treating or texturizing nozzle is appropriately closed, the planar faces or surfaces 26 and 28 make face-to-face contact and form a seal against passage of texturizing fluid between them.

Nozzle part 10 has a groove 34 in the planar face or surface 26 extending from one end of the block (the downstream end). Nozzle part 12 has a groove 36 in the planar face or surface 28, extending from one end to the other of the plate-like element and being slightly widened at its upstream end (see FIG. 1). When the planar faces or surfaces 26 and 28 are brought into appropriate engagement, the grooves 34 and 36 are aligned to provide a thread-treating passage 100 extending from end to end through the nozzle but of varying cross-section therealong.

This thread-treating passage 100 defines a thread path through the nozzle, various details of which can be obtained from the prior applications. Treatment fluid is fed into the thread-treating passage 100 at a junction location 42 (FIG. 1) at which the thread and the fluid are brought together. The treatment fluid is fed to the junction location 42 by way of a bore 52 in nozzle part 10 leading to a chamber 54 and thence by way of a metering tube 56 to the junction location 42. The chamber 54 opens onto the upstream end of the block or nozzle part 10, and is closed in use by a closure plate 63 which can be removed to give access to the chamber 54 and the metering tube 56. The metering tube 56 is retained in the desired position by means of a compression spring 60 extending between the closure plate 63 and the metering tube 56. A thread guide 61, secured to the closure plate 63, assists in guiding a thread correctly into the thread-treating passage 100.

A receiving device 222 such as a texturizing chamber (see FIGS. 3 and 8) is provided adjacent the downstream end of the thread-treating passage 100 by suitable formation of the block or nozzle part 10 and plate or nozzle part 12 as shown, for instance, in the published European Patent Application No. 108,205 and the corresponding U.S. application Ser. No. 433,733 referred to above and the disclosure of which is incorporated herein by reference. Treatment fluid is permitted to leave the texturizing chamber transversely of the thread path and passes into an outflow port 72 (in block or nozzle part 10) which contains a flow-controlling throttle 76.

The structure now to be described differs radically from that shown in the aforementioned European Published Patent Application No. 110,359, published June 13, 1984 and the cognate U.S. application Ser. No. 07/327,384, filed Mar. 21, 1989, and new reference numerals will be used. The plate element or nozzle part 12 is mounted on a plate-mounting structure generally indicated by the reference numeral 120. This structure comprises a box-like support and housing portion 122. As best seen in the section in FIG. 2, the housing portion 122 is open-sided on its side facing block or nozzle part 10 and plate-element or nozzle part 12 is located to cover or obturate this open side of the housing portion 122. Element or nozzle part 12 is retained relative to the housing portion 122 by means of four retaining devices 124 (one of which is only visible in FIG. 1) adjacent respective corners. Each retaining device 124 comprises a sleeve 126 with an internal screw thread and a pair of screws entering the sleeve from opposite ends thereof.

For reasons which will become clear hereinafter, the retaining effect of the retaining devices 124 permits some relative movement between element or nozzle part 12 and the housing portion 122. For this purpose, a clearance is left between element or nozzle part 12 and the respective sleeve 126 of each retaining device 124, and a compression spring 128 is provided between the head of one screw and an abutment surface in the housing portion 122.

Within the box-like support or housing portion 122 there are two chambers 132 and 134 separated by a transverse partition 130 (FIG. 1). The upper chamber 132 which is at the upper end of the thread-treating nozzle as viewed in FIG. 1, together with the contents thereof, will be described in detail. The lower chamber 134, and the contents thereof, are substantially the same, and will not be described separately.

A through-bore 136 (FIG. 2) extends transversely through the housing portion 122 at right angles to the thread-treating passage 100 and substantially parallel to the planar faces 26 and 28. The bore 136 is so located that the longitudinal axis thereof lies approximately in the plane of the surface defining the back or rear wall of the upper chamber 132 (See FIG. 1), that is the surface opposite the open front side of the upper chamber 132. A cylindrical pin 138 is located, for example by means of a press fit in the bore 136, so that the cylindrical pin 138 extends across the whole width of the upper chamber (FIG. 2). Seated on the cylindrical pin 138 is a pair of levers 140 and 142, both of which are visible in FIG. 2 but only one of which can be seen in FIG. 1. Each lever 140 and 142 is in the form of a rectangular bar, and these levers are disposed (as best seen in FIG. 2) adjacent respective side walls of the upper chamber 132. Each such rectangular bar has a semi-circular recess corresponding to the cylindrical pin 138, and when seated on the cylindrical pin 138, each bar or lever 140 and 142 is spaced slightly from the back surface of the upper chamber 132. Thus, the bars or levers 140, 142 are free to pivot slightly about the longitudinal axis of the cylindrical pin 138.

The bars or levers 140, 142 are joined at their upper ends by a pin 144 and at their lower ends by a pin 146, each of these pins 144 and 146 having a longitudinal axis parallel to the longitudinal axis of the cylindrical pin 138. Seated on the pin 144 is a lever 148, and seated on the pin 146 is a lever 150. These levers 148 and 150 each have a semi-circular recess corresponding to the respective pins 144 and 146, and each has at its upper and lower ends a respective forwardly projecting abutment portion 152. As can be seen in both FIGS. 1 and 2, the abutment portions 152 project beyond the front, open side of the housing portion 122, whereas all other parts of the lever structure remain within the upper chamber 132. The abutment portions 152 engage the reverse face of plate or nozzle part 12 so that a gap 154 is left between plate or nozzle part 12 and the front edge of the support portion or plate-mounting structure 120. Each lever 148 and 150 is free to pivot about the longitudinal axis of its pin 144 or 146 until each of the abutment portions 152 engages the reverse face of plate or nozzle part 12. Thus, the levers 140 and 142 and the pins 138, 144 and 146 and the levers 148 and 150 constitute balancing or compensational means for uniformly applying a closing or closure force to the thread-treating nozzle.

It will be seen from FIGS. 1 and 2 that the overall external dimensions of the combination of plate or nozzle part 12 and its support or plate-mounting structure 120 correspond very closely with those of block or nozzle part 10. This enables the combination of nozzle part 12 and the plate-mounting structure 120 to be mounted in a suitable mounting system (not shown) which has been designed to receive a pair of block-type nozzle parts, for example as shown in the above-mentioned European Patent Application No. 108,205 and the cognate U.S. application Ser. No. 433,733. For this purpose, the support or plate-mounting structure 120 is provided with suitable openings 154' for cooperation with suitable, not particularly shown, retaining elements of the mounting system which can be identical with that shown in the above-mentioned European Patent Application No. 108,205. This exchangeability of part types is not, of course, essential but does enable substitution of the combination of nozzle part 12 and the plate-mounting structure 120 in existing nozzle structures.

Whatever mounting system is used for block or nozzle part 10 and the combination of nozzle part 12 and the plate-mounting structure 120, these parts will be associated in use with a nozzle closing system. This could be, for example, of the general type shown in the above-mentioned European Patent Application No. 110,359 and the cognate U.S. application Ser. No. 81,051 comprising a scissors-type linkage with block or nozzle part 10 and the combination of nozzle part 12 and the plate-mounting structure 120 mounted on respective arms of the scissors linkage, with those arms being openable and closable by a suitable drive mechanism, for example the pressurizable piston and cylinder unit shown in the above-mentioned European Application No. 110,359 and cognate U.S. application Ser. No. 07/327,384. Thus, such conventional nozzle closing system has been merely schematically indicated in FIG. 1 by reference character 40. As the scissors linkage urges nozzle parts 10 and 12 together, ramp elements 156 (see especially FIG. 2) tend to cancel out any coarse misalignment, and a locating pin 158 on plate or nozzle part 12 enters a locating opening 160 in block or nozzle part 10 to ensure the required alignment of the grooves 34, 36 to form the thread passage 100. In FIG. 1, the pin 158 is hidden behind an element 156 on plate or nozzle part 12.

The material and the dimensions of plate or nozzle part 12 are so selected in relation to the closing forces applied by the closing system that plate or nozzle part 12 is elastically deformable under those forces when the planar face or surface 28 is driven against the planar face or surface 26. Elastic deformation is hindered only in those regions in which plate or nozzle part 12 is contacted by the abutments 152, that is in eight specific contact regions (four associated with the upper chamber 132 and four with the lower chamber 134). The arrangement of levers within each chamber is such that each abutment 152 achieves a predetermined area of contact with plate or nozzle part 12 and that the closing forces are evenly distributed between these eight contact areas. As can be seen from FIG. 2, each contact area straddles the thread path as viewed in a direction normal to the contact area. Accordingly, the closing force is applied in regions immediately bordering on the grooves 34 and 36 and at a plurality of intervals spaced along the length of the thread path.

It will now be assumed that the surface or planar face 28 first makes contact with the surface or planar face 26 in a localized zone at an arbitrary position on those surfaces or planar faces 26 and 28. Since the closing forces are distributed along the length of the nozzle, there will be a net moment tending to pivot plate or nozzle part 12 about its region of first contact with block or nozzle part 10 so as to bring other regions of the surfaces or planar faces 28 and 26 into face-to-face contact. Since plate or nozzle part 12 is elastically deformable as referred to above, i.e. resilient, it can flex in response to this net moment so that face-to-face contact is made at least over the central zone of each of the surfaces or planar faces 26 and 28 (that is, the zones to either side of the grooves 34 and 36), and along the full length of the thread path. Depending upon the mismatching of the surfaces or planar faces 26 and 28, face-to-face sealing contact may not be achieved in regions close to the longitudinal edges of those surfaces or planar faces 26 and 28. However, this is not essential for practical purposes provided sealing contact has been made in the central zones referred to above.

In the above description, attention has been concentrated upon the flexing or resiliency of plate or nozzle part 12 in order to ensure sealing contact despite inevitable inaccuracies in manufacture and assembly. However, the adjustable mounting provided by the lever systems within the housing portion 122 also permits some adjustment of plate or nozzle part 12 relative to block or nozzle part 10 during the closing movement even without flexing of plate or nozzle part 12. Such adjustment has already been referred to in the above-mentioned European Patent Application No. 110,359 and cognate U.S. application Ser. No. 07/327,384, and this application also shows a mounting system for blocks (such as block or nozzle part 10 and a combination of block: or nozzle part 12 and plate-mounting structure 120) to enable the mounting system to take up manufacturing and assembly inaccuracies. It may be found appropriate to arrange the mounting system to take up coarse inaccuracies, and to provide flexibility in plate or nozzle part 12 sufficient to enable fine adjustments to ensure sealing contact.

Plate or nozzle part 12 is preferably of metal and, for reasons given further below, preferably has excellent thermal conductivity or heat-conducting properties. In order to provide plate or nozzle part 12 with the maximum possible flexibility, it is preferably made as thin as possible while still leaving adequate strength for plate or nozzle part 12 to absorb the closing forces even after formation of the groove 36. The thermal conductivity or heat conducting properties of the combination of nozzle part 12 and the plate-mounting structure 120 are quite clearly different from those of, say, the block 12 shown in the above-mentioned European Patent Application No. 108,205 and cognate U.S. application Ser. No. 433,733. The provision of the respective upper and lower chambers 132 and 134 substantially reduces the cross section available for thermal conduction or heat flow in the combination of elements 12 and 120.

The bars or levers 140, 142 as well as the bars or levers 148, 150 are all illustrated in FIG. 1 as symmetrical elements. That is the cylindrical pins 144, 146 are located at equal distances from the cylindrical pin 138 and the abutment portions 152 are located at equal distances from the cylindrical pins 144, 146. This arrangement produces substantially equal closing forces at the surface of the plate or nozzle part 12. It will be appreciated that any of the bars or levers 140, 142 or 148, 150 can also be made asymmetrical. For instance, making the distance between cylindrical pin 144 and cylindrical pin 138 slightly less than the distance between cylindrical pin 146 and cylindrical pin 138 would apply a slightly greater closing force to the plate or nozzle part 12 near its free end than in its intermediate region. Analogously, making the distance between the abutment portion 152 shown uppermost in FIG. 1 and the cylindrical pin 144 slightly less than the distance between the cylindrical pin 144 and the abutment portion 152 located between the cylindrical pin 144 and the cylindrical pin 138 would also tend to produce a greater closing force near the end of the plate or nozzle part 12. Analogous alterations to the geometry of the bars or levers 140, 142, 148 and 150 can be employed to achieve any desired variation of the magnitude of the closing force applied to the plate or nozzle part 12.

Figure 3:
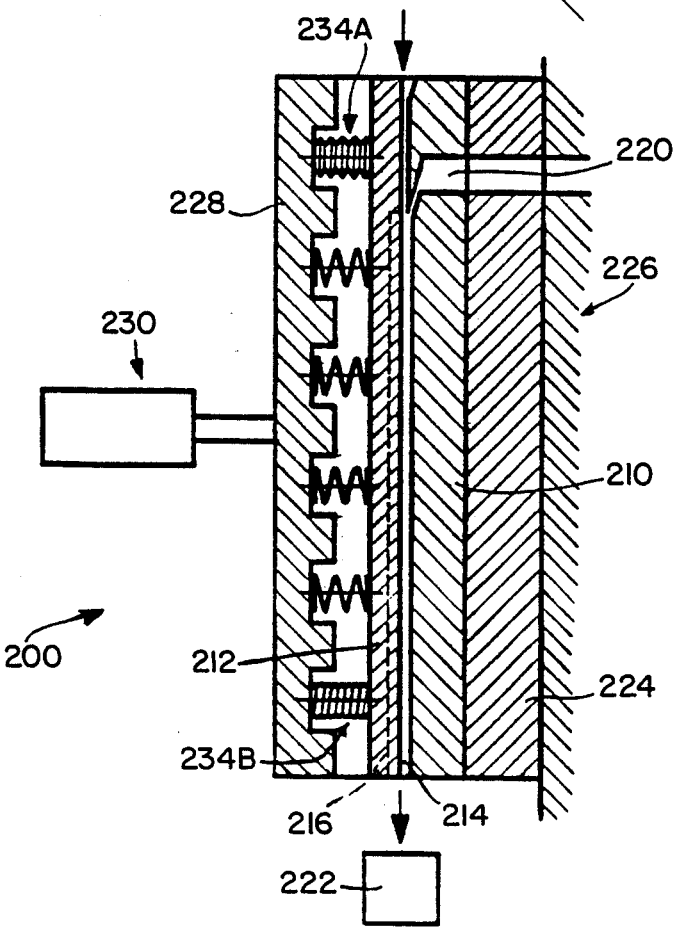
FIG. 3 is a longitudinally sectioned view of a further embodiment of thread-treating nozzle in accordance with the invention.

The nozzle assembly 200 of the embodiment shown in longitudinal section in FIG. 3 comprises a thread-treating nozzle made up of a relatively rigid block or block member or nozzle part 210 and a relatively elastic plate or plate member or nozzle part 212. The block or nozzle part 210 has a groove 214 extending from end to end thereof and forming a thread-treating passage through the nozzle, for instance a thread-texturizing passage. In a preferred embodiment, the thread-treating passage is provided solely by this groove 214 in the block or nozzle part 210. As indicated in dotted lines, however, a corresponding groove or groove portion 216 can be provided in the plate or nozzle part 212, so that at least part of the thread-treating passage is made up by the combination of the two grooves or groove portions 214 and 216. An embodiment of this type is illustrated in transverse section in FIG. 4, in which the thread-treating passage made up by the grooves or groove portions 214 and 216 is designated by the reference numeral 218.

The block or nozzle part 210 is provided with infeed means generally indicated by the reference numeral 220, by means of which a treatment fluid is fed into the thread-treating passage 218 at a position between the ends thereof. A suitable arrangement for this purpose is shown in the prior applications, and also in commonly assigned European Patent No. 123,829. Accordingly, those details will not be repeated here. The treatment fluid flows from its entry point into the thread-treating passage downwards as viewed in FIG. 3, thereby drawing or entraining a thread in the thread-treating passage 218 in the same direction as indicated by the arrows at the top and the bottom of the nozzle shown in FIG. 3. It will be noted that the upstream portion of the thread-treating passage 218, i.e. the portion thereof upstream of the entry point of the treatment fluid, is in any event provided simply by a groove 214 in the block or nozzle part 210 without any corresponding groove or groove portion in the plate or nozzle part 212.

In contrast to the nozzles shown in the prior applications, the nozzle illustrated in FIG. 3 does not include an integral texturizing chamber. The illustrated nozzle is designed primarily to exert a forwarding effect on the thread. By heating the infeed fluid (air, or possibly steam), the fluid may be arranged to also heat the thread, or at least to maintain a thread temperature previously achieved by preheating. As mentioned previously, the box 222 in FIG. 3 represents a receiving device for receiving the thread forwarded by the nozzle. As will be described with reference to FIG. 8, the device 222 can be designed to texturize the thread, but in a manner radically different from that illustrated in the prior applications. Of course, the nozzle shown in FIG. 3 could equally well be used in conjunction with a texturizing chamber as shown in those prior applications. However, the receiving device 222 could also take other forms.

Figure 4:
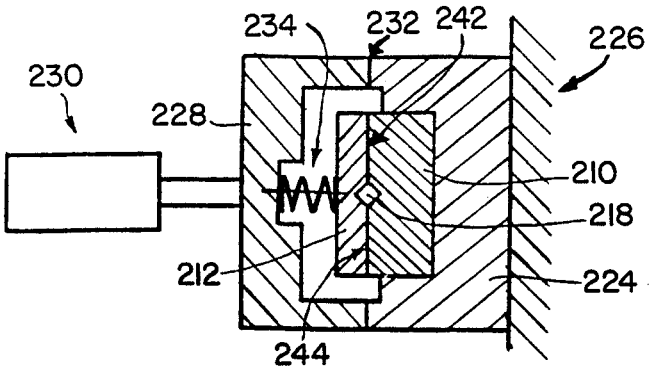
FIG. 4 is a transverse section of one form of thread-treating nozzle in accordance with the view shown in FIG. 3.

As in the case of the prior applications, the nozzle is of the openable and closable type to facilitate insertion of thread into the thread-treating passage, such as the thread-treating or forwarding passage 218 in FIG. 4. In the arrangement shown in that figure, block or nozzle part 210 is mounted in a housing portion 224 which is fixed to a suitable carrier generally designated by the reference numeral 226. The carrier 226 and the housing 224 have suitable openings aligned with the infeed means 220 in FIG. 3 to enable suitable supply of the treatment fluid.

Plate or nozzle part 212 is mounted in a second housing portion 228 which is acted upon by a piston and cylinder unit 230. When the latter is suitably pressurized, the housing portion 228 is forced to the right as viewed in FIGS. 3 and 4 so as to engage the housing portion 224 at a mutual contact surface 232. The thread-treating or forwarding nozzle is closed simultaneously, but the closure forces are not applied directly from the piston and cylinder unit 230; instead, they are applied indirectly through resilient means designated by the reference numeral 234 in FIG. 4. This resilient means 234 may comprise spring packets or packets of cup springs, i.e. for instance Belleville washers, as indicated by the reference numeral 234A in FIG. 3, or spiral compression springs as indicated by the reference numeral 234B in FIG. 3.

Figure 6:
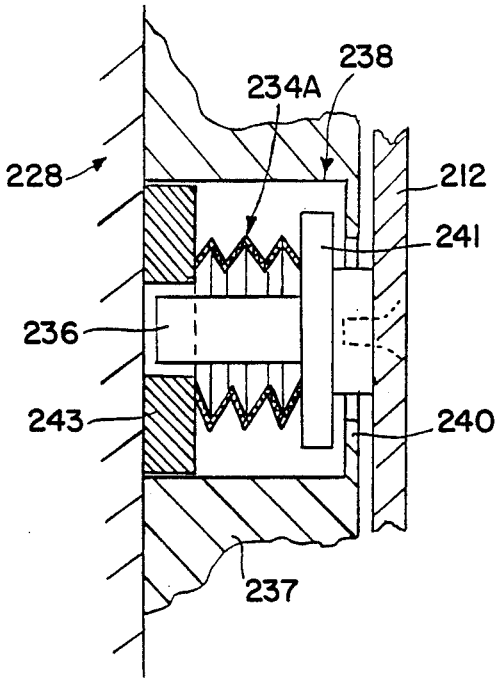
FIG. 6 is a section of a plate mounting suitable for use in the embodiments of FIGS. 4 and 5.

A method of mounting plate or nozzle part 212 on the housing portion 228 without interfering with the closing action applied by the resilient means 234 is indicated diagrammatically in FIG. 6. As illustrated there, a packet 234A of Belleville washers encircles a mounting pin 236 which is fixedly secured at one end, for example by screws, to plate or nozzle part 212. The pin 236 extends into a bore 238 in a sleeve 237 fixed (for example by screws) to the housing portion 228, and is movable in that bore 238 within limits defined by confining means now to be described.

At its end adjacent plate or nozzle part 212, the sleeve 237 has an inwardly projecting flange 240 engageable with a flange 241 on the pin 236 for limiting movement of plate or nozzle part 212 to the right (as illustrated in FIG. 6) relative to the housing portion 228. Plate or nozzle part 212 can, however, be forced to the left (as viewed in FIG. 6) relative to the housing portion 228 against the bias applied by the springs 234A until plate or nozzle part 212 sits on the sleeve 237. This reciprocal or back and forth movement or motion of plate or nozzle part 212 is limited in the transverse direction by confinement of the free end of the pin 236 in a bore of a guide ring 243 which is itself guided in the bore of the sleeve 237 and is pressed against the housing portion 228 by the springs 234A. The pin 236 has sufficient play relative to all guiding and confining surfaces to avoid interference as plate or nozzle part 212 flexes or deflects or deforms in use.

As indicated by the simple diagram in FIG. 4, plate or nozzle part 212 and block or nozzle part 210 ideally make sealing contact at all points on a sealing plane which intersects the thread-treating or forwarding passage 218 and which may be considered to be defined by a first pair of sealing surfaces 242 lying above the thread-treating passage 218 as viewed in FIG. 4, and a second pair of sealing surfaces 244 lying below the thread-treating passage 218 in that figure. Each pair of sealing surfaces 242 and 244 comprises one surface on block or nozzle part 210 and one surface on plate or nozzle part 212.

Figure 7A:
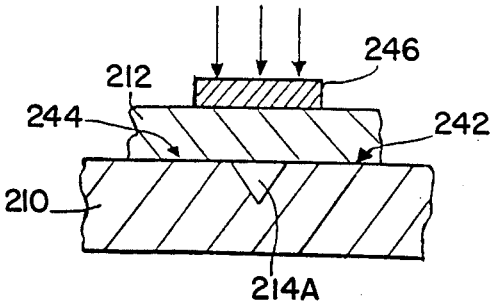
FIGS. 7A, 7B, 7C and 7D show details of sealing zones under varying circumstances.

In practice, it is not a simple matter to obtain the requisite mutual contact of the sealing surfaces 242 and 244, and some of the difficulties in this respect will now be explained in relation to the diagrams in FIGS. 7A, 7B, 7C and 7D. For purposes of illustration, an embodiment has been selected in which the thread-treating passage, corresponding to the thread-forwarding passage 218 in FIG. 4, is provided by a groove 214A in block or nozzle part 210 only. The groove 214A is assumed to be of triangular cross-section, but again, this is merely for purposes of illustration; the groove cross-section can be adapted to operating requirements. Plate or nozzle part 212 is designed to present a substantially planar surface to block or nozzle part 210, producing a thread-treating passage accurately defined by the groove 214A in block or nozzle part 210. A zone of contact between plate or nozzle part 212 and the closure force application means (resilient means 234) is indicated by a diagrammatically illustrated element 246 of the closure force application means. This element 246 can, for example, be one of the Belleville washers of the spring packet 234A, a part of the compression spring 234B, or (as in the preferred embodiment according to FIG. 6) a pressure plate interposed between the resilient means 234 and plate or nozzle part 212. As seen in FIG. 7A, the region of contact defined by the element 246 is aligned with the groove 214A (as also previously disclosed in the prior applications) thereby ensuring mutual sealing contact of the sealing surface pairs 242 and 244 in the regions immediately adjoining the groove 214A.

Figure 7B:
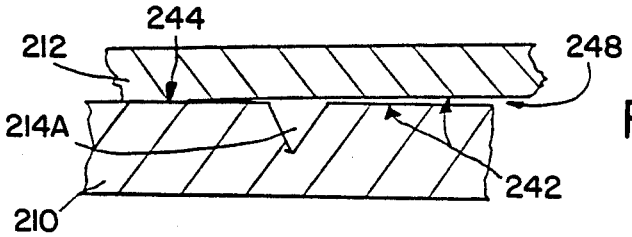

FIG. 7B indicates an alternative arrangement based upon principles shown in the aforementioned German Patent Publication No. 2,049,740 and the British Patent No. 1,310,227. In this arrangement, the closing or closure force is not applied in alignment with the groove 214A, but adjacent a non-illustrated hinge joining plate or nozzle part 212 and block or nozzle part 210 at one longitudinal edge thereof, assumed to be to the left of FIG. 7B.

When plate or nozzle part 212 has a certain degree of elasticity, there is the danger that a gap 248 will open up between the sealing surfaces 242 on the side of groove 214A opposite the non-illustrated hinge. If a further closure force is applied to correct the defect in FIG. 7B by urging the edge region of plate or nozzle part 212 remote from the hinge into contact with block or nozzle part 210, then the result illustrated in FIG. 7C may be obtained. In this case, sealing contact is made by the sealing surface pairs 242 and 244, but this sealing contact occurs in regions spaced from the groove 214A. Due to high operating pressure in the thread-treating passage, elastic plate or nozzle part 212 bows slightly as indicated by the reference numeral 250 in the region of groove 214A, and the effective cross-section of the thread-treating passage is no longer determined solely by the form of the triangular-section groove.

Figure 7C:
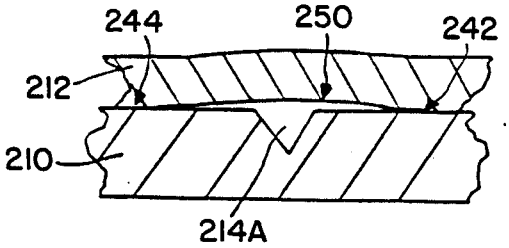
Figure 7D:
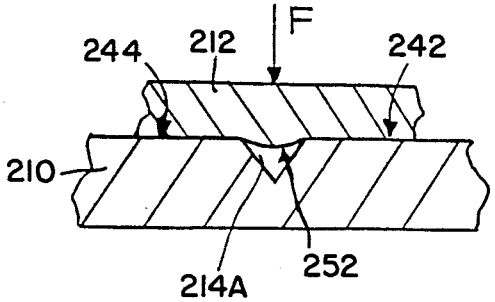

These effects have, of course, been exaggerated for purposes of illustration in FIGS. 7B and 7C. However, at least in texturizing of synthetic filament threads, even minor deviations from the required conditions illustrated in FIG. 7A can cause significant variation in thread characteristics from one thread-treating or texturizing nozzle to another. As previously noted in the prior applications, however, provided sealing contact is made between the sealing surface pairs 242 and 244 immediately adjacent the groove 214A, it is not important whether sealing contact is made in those edge regions of the surface pairs 242 and 244 remote from the groove 214A; when the thread-treating nozzle is closed, those edge regions are in any event isolated from the groove 214A by the illustrated regions of sealing contact to either side of the groove 214A.

The flexibility or elastic resiliency of plate or nozzle part 212 is determined by the constituent material of plate or nozzle part 212, as well as its form and dimensions. The flexibility of plate or nozzle part 212 must also be considered in relation to the applied closure forces. For example, in the situation illustrated in FIG. 7D, contact is made between the sealing surface pairs 242 and 244 in the required regions adjacent the groove 214A. However, with a highly localized closure force F, and a material of low elastic resistance in plate or nozzle part 212, the latter may be deformed into the groove 214A as indicated in exaggerated fashion by the ridge 252 in FIG. 7D. With a highly resilient material in plate or nozzle part 212, the effect illustrated in FIG. 7D might be obtained even without the "point contact" application of the closure force F indicated in that figure. This elastic deformation of plate or nozzle part 212 clearly alters the cross-section of the thread-treating passage from that determined by the groove 214A, and even entails the risk of plastic deformation of plate or nozzle part 212 (i.e. of a permanent set in the material of plate or nozzle part 212).

As far as the material is concerned, a metal is preferred for the thermal or heat conductivity reasons mentioned above and also discussed in the prior applications. However, the better thermally conductive or heat conducting metals (such as bronze or brass) are often not resistant to substances present in the treatment fluid (for example, to the spin finish applied to synthetic filament threads before they enter the texturizing stage of the production process). Chemical interactions may degrade the nozzle surface in the thread-treating passage and/or have an undesirable effect on the threads processed. This is especially true at higher processing temperatures. Nozzle temperatures in the range of 150° C. to 400° C. are used in texturizing synthetic filament threads, although temperatures in the range of 160° C. to 280° C. are most common.

The metal selected can be provided with a protective coating, but this will wear away and expose the underlying or base metal sooner or later. Accordingly, the preferred solution is to form the thread-treating passage itself in components made of a hard and inherently chemically resistant metal, and to enclose these components in a housing having at least relatively good thermal conductivity or heat conducting properties. Stainless steel (rust-resistant steel) is a convenient, chemically resistant material, but other tough, chemical and erosion-resistant metals can be used provided plates thereof with an adequate degree of flexibility or resiliency can be manufactured in the required dimensions.

As far as form is concerned, a simple rectangular form (with or without a groove to define the thread-treating passage) is preferred as illustrated in FIG. 4. This form of plate is relatively simple to manufacture. However, it is not essential to the invention; for example, the sealing surfaces 242 and 244 could be curved in transverse cross-section when the thread-treating nozzle is closed.

The thickness of plate or nozzle part 212 in a direction perpendicular to the sealing surfaces will exert a major influence upon the flexibility of plate or nozzle part 212. A further dimension exerting a significant influence upon the relevant flexibility of plate or nozzle part 212 is its width (a dimension conjointly perpendicular to the thickness as defined above and to the length dimension of the thread-treating passage). In a thread-treating nozzle forming part of a thread texturizing system using hot air as a treatment fluid, a stainless steel plate in the form shown in FIG. 4 may have a thickness in the range of 2 to 8 mm, and a width in the range of 12 to 25 mm. The lower limit of the plate thickness is given by the conveniently available means for manufacturing such a plate in the required form, while the upper limit of the thickness range is given by the loss in flexibility arising with increasing thickness. The preferred thickness range is from 3 to 6 mm. For purposes of comparison, it is mentioned that the thickness of a corresponding stainless steel block or nozzle part 210 may lie in the range of 8 to 15 mm. This thickness is relatively unimportant as far as flexibility/rigidity of the structure is concerned because block or nozzle part 210 is in any event extensively supported by the corresponding thermally or heat conductive housing portion 224. The thickness of such a stainless steel block or nozzle part 210 is preferably kept low for reasons of thermal conductivity, however.

Figure 8:
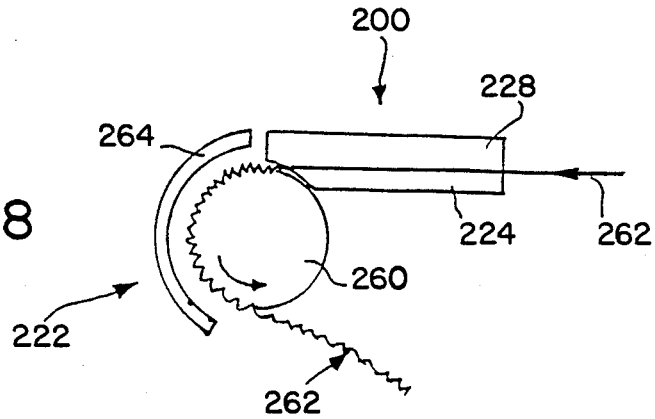
FIG. 8 is a diagrammatic side elevation of a thread-treating or texturizing apparatus employing a thread-treating nozzle in accordance with FIG. 3.

The length of plate or nozzle part 212 is clearly dependent upon the details of the thread-treating nozzle design; there will be a radical difference, for example, between a plate or nozzle part 212 for use in a thread-treating nozzle comprising an integrated texturizing chamber (as illustrated in the aforementioned two "prior applications") and a plate or nozzle part 212 for use in a thread-treating nozzle providing primarily a forwarding action urging a thread into a separately formed texturizing section, as generally indicated in FIG. 3 and as will be subsequently described in relation to FIG. 8. In any event, the length of plate or nozzle part 212 is of less significance as regards flexibility than the width thereof. If plate or nozzle part 212 is sufficiently flexible in the transverse direction (across its width), it will almost certainly prove to have sufficient flexibility in the longitudinal direction (along its length). As shown in FIG. 3, a number of closure force applying devices (resilient means 234) can be spaced along the length of the thread-treating nozzle to ensure that substantially strip-like sealing contact zones are created to either side of the thread-treating passage 218 along the full length thereof. The devices may be longitudinally spaced by a distance (center to center) of between 15 and 30 mm along the length of the thread-treating passage. The overall length of a thread-treating nozzle as shown in FIG. 3 (corresponding to the overall length of plate or nozzle part 212) may lie in the range of 60 to 150 mm. Shorter thread-treating nozzles generally are associated with higher operating temperatures.

Each closure device (resilient means 234, in the form of a spiral compression spring or packet of Belleville washers) may be adapted to apply a force in the range 400 to 800 Newton. The total closure force applied to plate or nozzle part 212 by all of the closure devices aligned with the thread-treating passage 218 may lie in the range 1'000 to 3'500 Newton, and there will commonly be four to six such devices in a thread-treating nozzle of the form shown in FIG. 3. The piston and cylinder unit 230 is preferably adapted to apply a greater force to the housing portion 228, for example a force exceeding the total closure force applied to plate or nozzle part 212 by approximately 50%.

Although plate or nozzle part 212 must be flexible to enable sealing contact to be made as described above, the material of plate or nozzle part 212 must be able to resist localized deformation in the region of the thread-treating passage. This has been explained by reference to FIG. 7C and FIG. 7D for the case in which plate or nozzle part 212 is designed to bridge a preformed groove in the other nozzle part.

It applies equally well, of course, when the thread-treating passage 218 is made up by grooves in both nozzle parts. In texturizing of synthetic filament threads, the thread-treating passage cross-section may lie in the range of 2.5 to 10 square millimeters at the junction region where the thread and treatment fluid are first brought together, and it may increase to a value in the range of 6 to 20 square millimeters at the downstream end of a thread-treating nozzle as shown in FIG. 3. The high pressures at the junction region are likely to lead to the greatest deformation problems.

Figure 5:
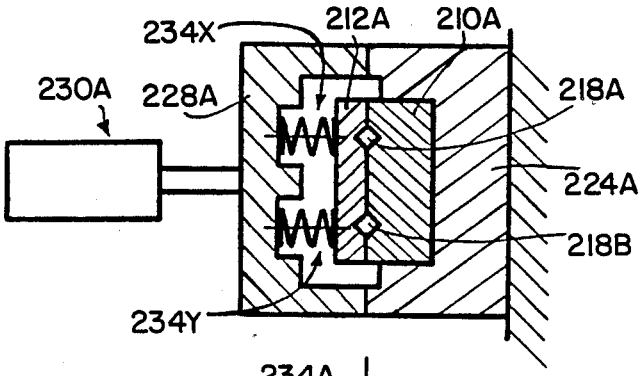
FIG. 5 is a transverse section of an alternative form of thread-treating nozzle, also in accordance with the view shown in FIG. 3.

As shown in FIG. 5, elastic or flexible plate or nozzle part 212 (and corresponding block or nozzle part 210) are arranged to define more than one thread-treating passage. In this case in particular, plate or nozzle part 212A and block or nozzle part 210A define two thread-treating passages 218A and 218B. A separate set of closure force applying devices is provided for each thread-treating passage, one set being designated by the reference numeral 234X and the other set by the reference numeral 234Y. Furthermore, if each thread-treating passage 218A and 218B is designed to treat the same thread type under the same treatment conditions as the thread-treating passage 218 illustrated in FIG. 4, then the width of plate or nozzle part 212A is approximately double the width of plate or nozzle part 212; thus, a stainless steel plate or nozzle part 212A preferably has a width in the range of 24 to 30 mm. The thickness of plate or nozzle part 212A still lies in the range of 2 to 8 mm, however. The piston and cylinder unit 230A must be adapted to apply to the housing portion 228A a force exceeding the total force applied to plate or nozzle part 212A by both sets of closure devices 234X and 234Y acting together.

As indicated diagrammatically in FIG. 7A, the vectors or lines of action of the force applying means acting on plate or nozzle part 212 preferably extend substantially at right angles to the sealing surfaces 242 and 244. The play provided in the mounting shown in FIG. 6 enables this effect to be maintained even when plate or nozzle part 212 flexes or deforms to accommodate slight misalignments in the nozzle structure—there is a corresponding tilt in the pin 236 relative to the sleeve 237 in the flexed region of plate or nozzle part 212.

The sealing surfaces 242 and 244 themselves are preferably finished by grinding during manufacture. There is no need for fine finishing operations such as lapping, polishing or superfinishing.

FIG. 8 indicates in a highly diagrammatic manner the use of a thread-treating nozzle in the form shown in FIG. 3 in a thread texturizing system which differs from that shown in the prior applications. The nozzle structure of a forwarding nozzle is again generally indicated by the reference numeral 200. The housing portion 228 and the elastic or flexible plate or nozzle part 212 provided therein are generally as shown in FIG. 3, but the housing portion 224 is formed at one end to match the surface of a rotating drum 260 which receives the thread from the thread-treating or forwarding nozzle 200. The drum 260 rotates in a counter-clockwise direction as viewed in FIG. 8. When the thread 262 has traveled with the drum 260 through approximately half a revolution thereof, it is transferred to a cooling means which is not shown in FIG. 8. A casing portion 264 encircles the drum 260 between the outlet from the forwarding nozzle 200 and the location of transfer to the cooling means. The drum 260 and the casing portion 264 are heated and form the actual texturizing chamber receiving thread from the thread-treating or forwarding nozzle 200. This form of texturizing system is of a known type, being described, for example, in the U.S. Pat. Nos. 4,024,611, 4,074,405 and 4,019,228. Accordingly, details of such arrangements will not be provided in this specification.

In this specification, the terms "flexible", "resilient" and "elastic" have been used to some extent interchangeably. Clearly, plate or nozzle part 212 (or an equivalent flexible part in an alternative thread-treating nozzle design) should not be subjected to plastic deformation. "Perfect elasticity" is, however, obviously not essential.

The invention has been described primarily in reference to a texturizing nozzle, particularly one in accordance with prior patent applications. The invention is not, however, limited to such use. It can be applied in any thread-treating nozzle, for example a nozzle for applying twist to thread or for creating so-called "entanglements" (an "interlacing nozzle"), or even a nozzle for simple forwarding of a thread. However, the invention is considered to have its most useful application in texturizing nozzles where very considerable pressures of thread-treating medium (for example air or steam) are encountered.

In the present specification, the term "treatment" or "treating" is intended to cover any application of a pressurized fluid to a thread, whatever the purpose of the application. Thus, even the creation of a simple drawing or forwarding effect is considered in this context as a "treatment". In most cases, however, there will be an ancillary purpose such as heating or cooling the thread.

Clearly, both nozzle parts could be made flexible, but this may adversely affect the thermal conductivity or thermal conducting characteristics of the thread-treating nozzle taken as a whole, bearing in mind the desirability of making the passage-defining parts from a corrosion and erosion resistant metal. Good thermal conducting contact of at least one nozzle part with a body of relatively good thermal conductivity is advantageous.

While there are shown and described present preferred embodiments of the invention, it is to be distinctly understood that the invention is not limited thereto, but may be otherwise variously embodied and practiced within the scope of the following claims.

What I claim is:

1. A thread-treating nozzle, comprising:

at least one first nozzle part having a first pair of sealing surfaces;

at least one second nozzle part cooperating with said at least one first nozzle part to form a thread passage conjointly therewith and having a second pair of sealing surfaces contacting said first pair of sealing surfaces;

treatment fluid infeed means provided for one of said nozzle parts for the infeed of a treatment fluid to the thread passage;

said at least one first nozzle part being movably arranged in relation to said at least one second nozzle part;

said at least one first nozzle part having sufficient flexibility for permitting said first pair of sealing surfaces to at least predominantly conform to said second pair of sealing surfaces under the action of an externally applied closing force such that sealing contact is effected between said first pair of sealing surfaces and said second pair of sealing surfaces at least in a region surrounding said thread passage;

closure force applying means provided for said mounting means for exerting an externally applied closing force to said first nozzle part in substantial alignment with said thread passage to establish said sealing contact between said first pair of sealing surfaces and said second pair of sealing surfaces at least at said region surrounding said thread passage;

said closure force applying means for applying said externally applied closing force being structured to apply the closure force to said first nozzle part to act along lines of force extending substantially at right angles to said first and second sealing surface;

said closure force applying means including mounting means for movably and flexibly supporting said at least one first nozzle part for distributing said externally applied closing force over said at least one first nozzle part such that the application of said externally applied closing force to said first and second pairs of sealing surfaces is substantially perpendicular to said first and second pairs of sealing surfaces;

said mounting means comprising balancing means for distributing said externally applied closing force over said at least one first nozzle part;

said balancing means comprising:

lever means comprising a pair of levers;

a pivot mount for said pair of levers of said lever means;

at least two abutment elements for transmitting said externally applied closing force to said at least one first nozzle part; and respective abutment pivot mounts for securing each abutment element of said at least two abutment elements at said pair of levers and arranged on opposite sides of said pivot mount for said lever means.

2. The thread-treating nozzle as defined in claim 1, wherein:

said thread passage defines a predetermined thread path;

said pivot means for said pair of levers of said lever means having a pivot axis extending at substantially right angles to said predetermined thread path and in a plane extending substantially parallel thereto; and each said abutment pivot mount having a pivot axis extending at substantially right angles to said predetermined thread path and in said plane.

3. The thread-treating nozzle as defined in claim 1, wherein:

said at least one first nozzle part defining said first pair of sealing surfaces comprises a flexible plate member.

4. The thread-treating nozzle as defined in claim 1, wherein:

said at least one first nozzle part comprises a first groove formed between said first pair of sealing surfaces and defining lateral bearing surfaces on either side;

said at least one second nozzle part comprising a second groove formed between said second pair of sealing surfaces and defining lateral bearing surfaces on either side;

said first groove and said second groove cooperating to conjointly define said thread passage;

said at least one first nozzle part having a further surface opposite said first pair of sealing surfaces and extending substantially parallel to said first groove; and said thread-treating nozzle balancing means transmitting said externally applied closing force to said further surface such that pressure is applied to each of said lateral bearing surfaces for effective face-to-face sealing contact.

5. The thread-treating nozzle as defined in claim 1, wherein:

said lever means comprise double-armed lever structure defining said pair of levers at which there are mounted said at least two abutment elements.

6. The thread-treating nozzle as defined in claim 5, wherein:

said at least two abutment elements comprise a plurality of spaced apart abutment portions which contact the at least one first nozzle part having said sufficient flexibility at defined predetermined regions thereof; and said closure force applying means exerting the closing force upon said at least two abutment elements and said plurality of spaced apart abutment portions such that deformation of said at least one first flexible nozzle part is hindered only at said defined predetermined regions where the at least two abutment elements contact the at least one first nozzle part.

7. An openable and closable thread-treating nozzle comprising:

a first nozzle part and a second nozzle part which conjointly define between them a thread passage of predetermined cross-section extending through the thread-treating nozzle;

said first nozzle part and said second nozzle part being movable relative to each other for opening the thread-treating nozzle to permit insertion of a thread to be treated into said thread passage and for closing the thread-treating nozzle around said thread in said thread passage;

infeed means for feeding under pressure a treatment fluid to said thread passage to flow therethrough for entraining said thread along said thread passage;

said first nozzle part comprising first and second sealing surfaces disposed on respective opposite sides of said thread passage;

said second nozzle part comprising first and second sealing surfaces respectively corresponding to said first and second sealing surfaces of said first nozzle part;

closure force applying means for applying closure forces urging said first and second sealing surfaces of said first nozzle part into mutual contacting engagement with said corresponding first and second sealing surfaces of said second part;

at least said first nozzle part being flexible under the action of the applied closure forces;

said flexibility of at least said first nozzle part being such that at least said first nozzle part can deform under said closure forces for effecting mutual sealing contact between said first and second sealing surfaces of said first nozzle part and said first and second sealing surfaces of said second nozzle part and such that said first nozzle part still remains sufficiently rigid under the closure forces and the pressure of said treatment fluid to substantially prevent variation of said predetermined cross-section of said thread passage due to the closure forces and the pressure of the treatment fluid;

said closure force applying means comprise tiltable mounting means cooperating with said first nozzle part to allow said closure force applying means to undertake tilting motion during any possibly arising deformations of said first nozzle part.

8. The thread-treating nozzle as defined in claim 7, wherein:

each nozzle part of said first nozzle part and said second nozzle part comprises corrosion-resistant metal.

9. The thread-treating nozzle as defined in claim 8, further including:

a housing for housing said first nozzle part and said second nozzle part; and said housing comprising a material having good thermal conductive properties relative to those of said corrosion-resistant metal.

10. The thread-treating nozzle as defined in claim 7, wherein:

said second nozzle part is more rigid than said first nozzle part; and said predetermined cross-section of said thread passage being defined by a groove formed in said second nozzle part.

11. In a thread treating nozzle, the combination comprising a first nozzle part having a planar face and a groove in said face;

a second elastically deformable nozzle part having a planar face and a groove in said face;

means for moving said nozzle parts relative to each other between an open position with said faces spaced from each other and a closed position with said faces in contact with each other with said grooves defining a thread passage; and a support for said second nozzle part, said support including a housing portion and means for applying spaced apart closing forces on said elastically deformable nozzle part in said closed position thereof, said closing forces being applied in regions of said grooves of said second nozzle to deform said second nozzle part to place said planar surfaces in face-to-face sealing contact along and on opposite sides of said grooves, said means including a plurality of levers pivotally mounted within said housing portion, at least two of said levers being disposed longitudinally of said second nozzle part, each of said latter levers having a pair of spaced abutment portions abutting said second nozzle part for applying said closure forces thereon.

12. The combination as set forth in claim 11 wherein said second nozzle part is a plate.

13. In a thread treating nozzle, the combination comprising a first nozzle part having a planar face and a groove in said face;

a plate forming an elastically deformable nozzle part having a planar face and a groove in said face;

means for moving said nozzle parts relative to each other between an open position with said faces spaced from each other and a closed position with said faces in contact with each other and with said grooves defining a thread passage; and a support for said second nozzle part, said support including a plurality of pivotally mounted levers disposed longitudinally of said plate for applying spaced apart closing forces on said elastically deformable nozzle part in said closed position thereof, each said lever having a pair of spaced abutment portions abutting a rear face of said plate for applying said closing forces thereon to deform said second nozzle part to place said planar surfaces in face-to-face sealing contact along and on opposite sides of said grooves.

14. A thread treating nozzle comprising a first nozzle part having a groove for receiving a travelling thread;

a second elastically deformable nozzle part;

a support for said second nozzle part;

means for moving said first nozzle part and said support with said second nozzle part relative to each other between an open position with said nozzle parts spaced from each other and a closed position with said nozzle parts in contact with each other; and means operable between said support and said second nozzle part when said nozzle parts are in said closed position to apply closing forces to said second nozzle part to place said nozzle parts in sealing contact along surfaces on opposite side of said groove with said closing forces being sufficient to deform said second nozzle part entirely across the cross-section thereof where said nozzle parts are not in sealing contact to effect sealing contact therebetween.

15. A thread treating nozzle as set forth in claim 14 wherein said closing forces are applied at right angles to said surfaces.

16. A thread treating nozzle as set forth in claim 14 wherein said second nozzle part is a plate.

17. A thread treating nozzle as set forth in claim 14 wherein said surfaces are disposed in longitudinal sealing zones on said first nozzle part immediately adjacent and parallel to said groove and in corresponding zones of said second nozzle part.

18. In a thread treating nozzle, the combination comprising a first nozzle part having a longitudinal groove;

a second elastically deformable nozzle part facing said first nozzle part and being movable into a closed position with said first nozzle part with said groove defining a thread passage; and means for applying closing forces on said second nozzle part to place said first and second nozzle parts in sealing contact along sealing surfaces on opposite sides of said groove, said closing forces being applied at right angles to said sealing surfaces and groove with said closing forces being sufficient to deform said second nozzle part entirely across the cross-section thereof where said nozzle parts are not in sealing contact to effect sealing contact therebetween.

19. The combination as set forth in claim 18 wherein said second nozzle part is a plate.

20. The combination as set forth in claim 18 wherein said closing forces are applied at longitudinally spaced apart points of said second nozzle part.

21. The combination as set forth in claim 18 wherein said means includes a plurality of longitudinally spaced apart springs.

22. The combination as set forth in claim 21 wherein said springs are aligned with said groove.

* * * * *

UNITED STATES PATENT AND TRADEMARK OFFICE

CERTIFICATE OF CORRECTION

PATENT NO. : 4,941,242

DATED : July 17, 1990

INVENTOR(S) : WERNER NABULON

It is certified that error appears in the above-identified patent and that said Letters Patent is hereby corrected as shown below:

Column 1, line 7 insert the following paragraph:
--This application and its above-cited parent application are both related to the commonly assigned, copending United States Application Serial No. 81,051, filed October 2, 1979, and entitled "LACING UP OF THREAD THREATING NOZZLES" (now abandoned).--
Column 4, line 38 "will should be -will not-
Column 5, line 49 "327,384" should be -81,051-
Column 7, line 29 "327,384" should be -81,051-
Column 8, line 25 "327,384" should be -81,051-
Column 8, line 28 "block:" should be -block-
Column 16, line 48 "means" should be -mount-
Column 18, line 11 "motion" should be -motions-
Column 19, line 32 "side" should be -sides-

Signed and Sealed this

Twenty-first Day of January, 1992

*Attest:*

HARRY F. MANBECK, JR.

*Attesting Officer*

*Commissioner of Patents and Trademarks*